United States Patent [19]

Schmedding

[11] Patent Number: 4,952,156

[45] Date of Patent: Aug. 28, 1990

[54] CONNECTOR AND A METHOD OF MANUFACTURING A PLURALITY OF CONTACT TERMINALS MOUNTED ON A CONTINUOUS CARRIER STRIP

[75] Inventor: George R. Schmedding, Hummelstown, Pa.

[73] Assignee: AMP Incorporated, Harrisburg, Pa.

[21] Appl. No.: 314,620

[22] Filed: Feb. 23, 1989

[51] Int. Cl.[5] ..... H01R 9/09

[52] U.S. Cl. ..... 439/66; 439/590; 439/591

[58] Field of Search ..... 439/55, 66, 741, 870, 439/590, 591; 29/883, 884; 206/330

[56] References Cited

U.S. PATENT DOCUMENTS

| | | | |
|---|---|---|---|
| 1,514,618 | 11/1924 | Ide | 206/330 |
| 2,774,053 | 12/1956 | Seger | 439/722 |
| 3,182,276 | 5/1965 | Ruehlemann | 206/330 |
| 3,482,301 | 12/1969 | Perrella . | |
| 3,618,207 | 11/1971 | Sand . | |
| 3,638,163 | 1/1972 | Loosme | 339/17 |
| 3,795,884 | 3/1974 | Kotaka | 339/17 |
| 3,951,493 | 4/1976 | Kozel | 339/17 |
| 4,109,378 | 8/1978 | Davies | 29/629 |
| 4,199,209 | 4/1980 | Cherian | 339/59 |
| 4,245,876 | 1/1981 | Ritchie et al. | 439/65 |
| 4,664,458 | 5/1987 | Worth | 439/66 |
| 4,665,614 | 5/1987 | Stipanuk et al. | 29/884 |
| 4,699,593 | 10/1987 | Grabbe et al. | 439/71 |
| 4,769,908 | 9/1988 | Olsson | 29/884 |

FOREIGN PATENT DOCUMENTS

| | | |
|---|---|---|
| 0053968 | 6/1982 | European Pat. Off. . |
| 1529405 | 5/1968 | France . |

*Primary Examiner*—Neil Abrams

*Attorney, Agent, or Firm*—Bruce J. Wolstoncroft

[57] ABSTRACT

A method of manufacturing produces a plurality of contact terminals (26) in a continuous, uninterrupted strip form. The method comprises the steps of: stamping a contact electrical terminal (26) from conductive material having certain desired spring characteristics, so that the contact terminal (26) has a spring end (30) and a crimp end (34) having a crimp opening (42) therein, crimping the contact terminal crimp end (34) onto a continuous length of electrically insulating material (66), and repeating the above steps until a plurality of spaced apart contact terminals (26) is provided in a continuous, uninterrupted strip.

12 Claims, 3 Drawing Sheets

CONNECTOR AND A METHOD OF MANUFACTURING A PLURALITY OF CONTACT TERMINALS MOUNTED ON A CONTINUOUS CARRIER STRIP

FIELD OF THE INVENTION

The invention relates to an electrical connector and a method of producing the same. More particularly, the electrical connector has a strip of electrical terminals which has at least one strip of uninterrupted insulation material attached thereto. The insulation material precisely maintains the terminals in the proper spaced relationship such that the strip of insulation material can act as a carrier strip.

BACKGROUND OF THE INVENTION

It has been the practice in the prior art to stamp and form electrical contacts or terminals from a continuous strip of metal. The contacts at first were individually assembled to a printed circuit board and then soldered in place. The disadvantage of such a technique involved a requirement for hand labor to sort the contacts from one another, to assemble the contacts in desired alignment within the board, and to straighten the contacts in their final desired positions after soldering the contacts in place. Because hand labor is costly, there has been considerable effort directed toward reducing the amount of hand labor required for assembly of contacts to a printed circuit board. One of the first improvements to result from such effort resided in locating the terminals serially along a common carrier strip which was formed integral with the terminals during the stamping and forming process. This permitted the carrier strip to be fed into an insertion machine which individually severed a terminal from the strip and forcibly inserted it into a printed circuit board. The prior art further evolved into a technique whereby a plurality of electrical terminals along a common carrier strip were located within a cob-type tool which aligned the plurality of terminals for simultaneous insertion within corresponding locations in a circuit board. Using this technique, insertion of a larger number of terminals were simultaneously inserted, the common carrier strip served to align the terminals while the terminals were soldered in place within the printed circuit board. Subsequently, the carrier strip was removed from the terminals, leaving the terminals individually located within the printed circuit board.

Another version of the above techniques is described in U.S. Pat. No. 3,618,207 wherein a plurality of terminals, which extend transversely from a common carrier strip, has a body of insulating material molded transversely across the contacts. This molding is done using an intermittent molding process which provides individual housings.

Another prior art connector is the AMPLIFLEX Surface-To-Surface Connector sold by AMP Incorporated. The AMPLIFLEX connector is a thin flexible polyimide film on which individual parallel lines of etched cooper circuitry plated with gold over nickel is wrapped around a soft, non-conducting silicone rubber core. The core is formulated to resist permanent set under long term compression. When the connector is compressed between two flat planes, the plated circuit lines interconnect circuit pads on each plane. The resiliency of the connector core accommodates irregular and warped surfaces.

U.S. Pat. No. 4,245,876 discloses a continuous strip of electrical terminals which is formed by stamping rectangular openings in a strip of metal. A strip of dielectric material is then adhered to the metal strips, after which the metal strips are formed into electrical terminals of a selected configuration. Discrete lengths of the formed terminals in strip form are held together as separate terminals via the dielectric material which can be severed from the continuous strip for specified uses.

U.S. Pat. No. 4,769,908 discloses a method of producing a plurality of identical electrical terminals from a metal strip having the desired spring and conductive characteristics. At least one row of rectangular openings is stamped in the metal strip. The rectangular openings are positioned such that the longitudinal axis of the openings are essentially perpendicular to the longitudinal axis of the metal strip. After the openings have been stamped, a web of insulation material is molded onto the strip of metal in alignment with each row of openings.

SUMMARY OF THE INVENTION

Disclosed is a method of manufacturing a plurality of contact terminals in a continuous, uninterrupted strip form. The method comprises the steps of: stamping a contact electrical terminal from conductive material having certain desired spring characteristics, so that the contact terminal has a spring end and a crimp end having a crimp opening therein, crimping the contact terminal crimp end onto a continuous length of electrically insulating material, and repeating the above steps until a plurality of spaced apart contact terminals is provided in a continuous, uninterrupted strip.

In one embodiment, the opening in the crimp end is open in a direction opposite the spring end, and the conductive material is in the form of a flat metal wire.

In one embodiment, the method further includes the step of applying an electrically insulating material to at least one side of the flat wire prior to stamping the contact terminals from the wire. The contact terminals are then crimped onto the strip of insulating material so that the layer of insulating material is between each of the terminal's conductive material.

In one embodiment, the spring end is formed by stamping an opening open in a direction opposite the crimp end opening, and the crimp end is formed by stamping the outer edges of the contact crimp end to thereby reduce its outer dimensions. The method further includes the step of plating the outer edges of the metal wire, prior to stamping the contact terminal from the flat wire, with a conductive material more conductive than the flat wire metal.

Also disclosed is an electrical connector comprising a electrically insulating carrier strip, and a plurality of adjacent contact terminals, each of the contact terminals being crimped on the carrier in a spaced apart fashion to form a continuous, uninterrupted contact strip.

An object of the present invention is to provide a method for producing a plurality of electrical terminals which can be produced in a continuous, uninterrupted strip form, and which can be cut to any length desired.

A further object of the present invention is to provide a strip of insulation material which will maintain the proper spacing of the terminals, as discussed, such that the insulation material will function as the carrier strip.

Another object of the present invention is to provide a method of manufacture which can be done at a constant high rate of speed, using a minimal amount of steps to produce the plurality of terminals. The present invention can produce a plurality of terminals at speeds comparable to those with the U.S. Pat. No. 4,245,876 method, but with less production steps.

Another object of the present invention is to utilize technology known and used in the production of zippers in order to produce an electrical contact.

DETAILED DESCRIPTION OF THE INVENTION

Figure 1:
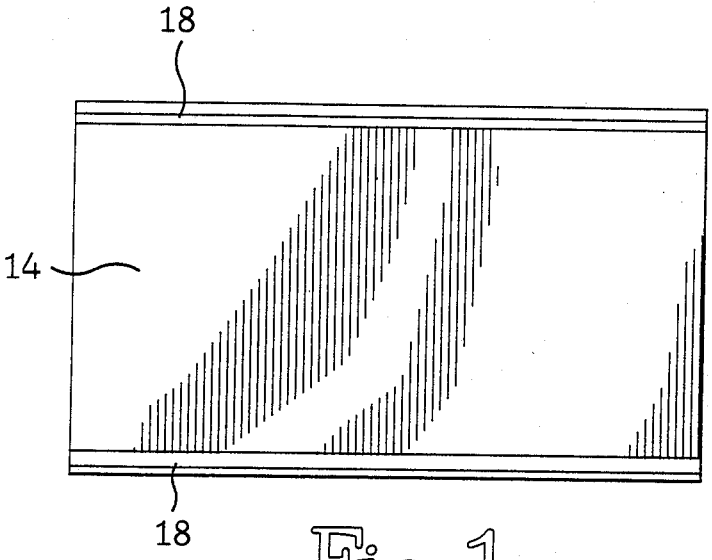
FIG. 1 is an enlarged front view of a flat metal wire with outer edges plated with a more electrically conductive metal, and with a layer of insulating material.
Figure 2:
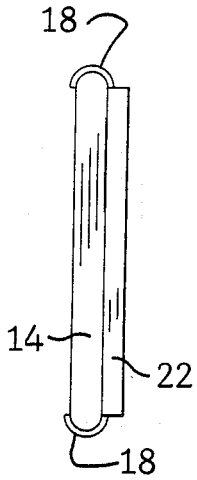
FIG. 2 is a side view of the flat wire shown in FIG. 1.

In the zipper manufacturing industry, a machine, such as the zipper chain machine sold by the Murko Machinery Company, or the one illustrated in U.S. Perrella Patent 3,482,301, which is incorporated herein by reference, stamps pieces from a flat metal wire, then crimps then onto a strip of fabric. Two of these strips are then joined together to form a common zipper, such as the one used in garments. These machines are known to be able to stamp and crimp pieces onto a carrier strip with good spacing accuracy, accomplishing the whole process at a fairly high rate of speed (about 8 feet per minute).

Illustrated in the drawings is a method of manufacturing a plurality of contact terminals in a continuous, uninterrupted strip form. The process or method of this invention utilizes this technology known and used in the zipper manufacturing industry in a novel manner in order to make an electrical connector 10.

More particularly, the process begins with the selection of a flat wire 14 made of an electrically conductive material having desirable spring characteristics. In the preferred embodiment, BeCu is used. In this embodiment, the outer edges of the flat metal wire are plated with a conductive material 18, such as gold, which is more conductive than the flat wire metal 14, thereby increasing the overall electrical current carrying capabilities of the conductive material In order to minimize the cost of plating, selective plating may be performed.

Figure 5:
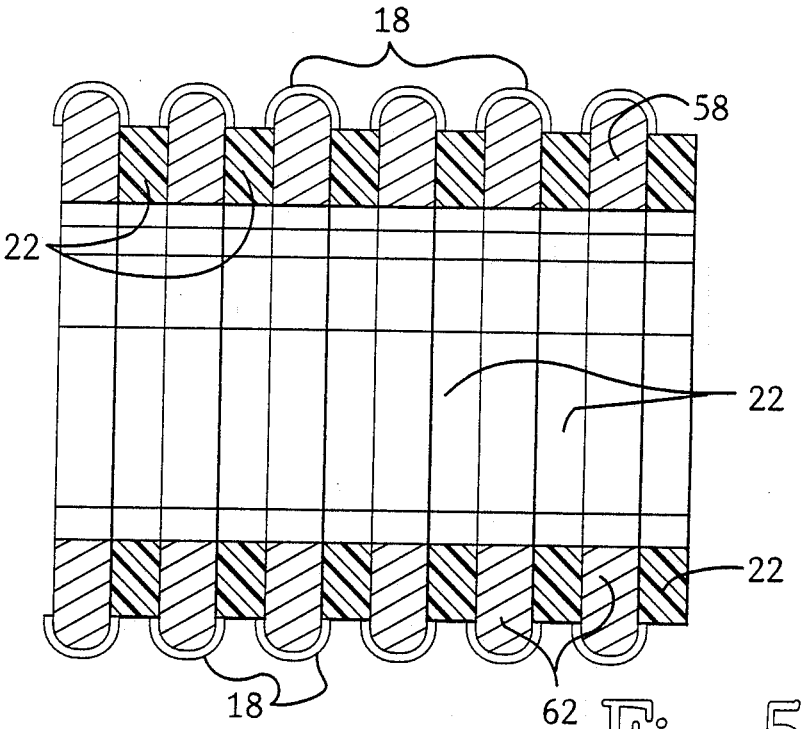
FIG. 5 is an enlarged cross sectional view of the connector shown in FIG. 4, taken along the line 5—5 in FIG. 4.
Figure 4:
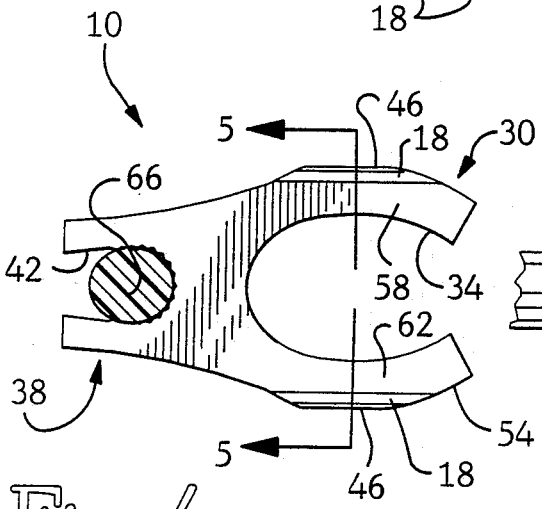
FIG. 4 is an enlarged view of a plurality of the contact terminals shown in FIG. 3, crimped onto a strip of electrically insulating material.
Figure 6:
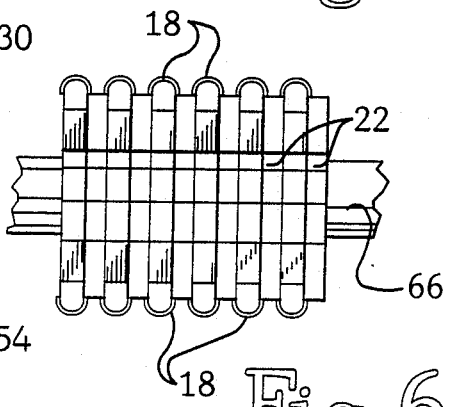
FIG. 6 is a side view of the connector shown in FIG. 4.

A suitable electrically insulating material 22 is applied to one side of the flat metal wire 14, in a sufficient thickness so as to prevent the passage of any current between adjacent terminals, when the insulating material is between the terminals, as illustrated in FIG. 5. In the preferred embodiment, the insulating material 22 is a sprayed on insulating enamel, applied in a manner similar to the way paint enamel is applied to metal zippers. In other embodiments, a dielectric sheet of material, such as Mylar or Kapton, can be laminated to the side of the wire. It is important to note that the edges of the flat metal wire must not have the insulating material applied thereto.

Figure 3:
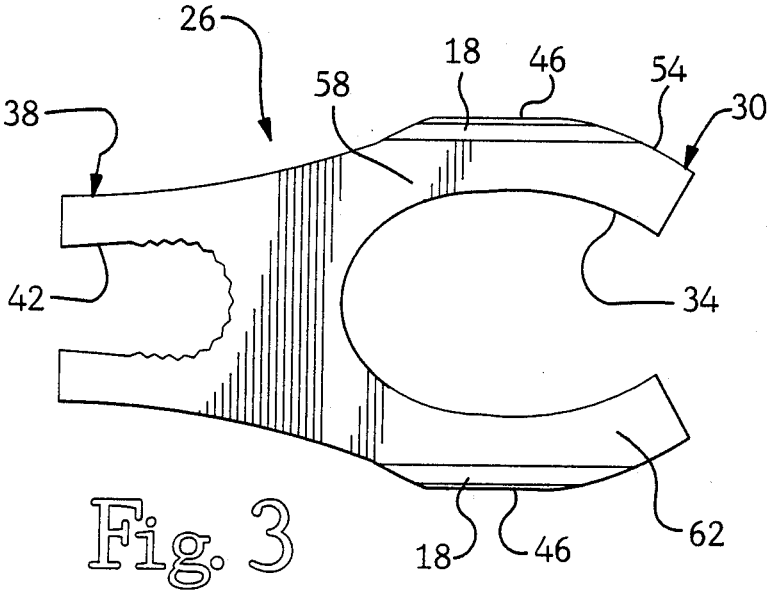
FIG. 3 is a view of the flat metal wire shown in FIG. 1, after having been stamped to form a contact terminal.

An insulated contact terminal 26 is then stamped from the flat metal wire 14. The stamping process, which preferably occurs in a single stroke, produces a spring end 30 formed by an opening 34 in an end of the contact terminal 26, and a crimp end 38 having a crimp opening 42 therein open in a direction opposite the spring end 30. The terminal 26 is also stamped, as illustrated in FIG. 3, so that the outer edges of the contact crimp end 38 have outer dimensions which are less than the outer dimensions of the spring end outer edges 46. The spring end corners 54 are also rounded. The spring end 30 thus comprises a generally "C" shaped member having first and second spring arms, 58 and 62, respectively. Other embodiments of contact terminal 26 are possible. In particular, crimp opening 42 can open in a direction toward the spring end 30 or in a direction which is perpendicular to the spring end 30.

After each of the contact terminals 26 is formed, as described above, the contact terminal crimp end 38 is crimped onto a continuous length of flexible electrically insulating material in the form of a cord 66, so that the terminal insulating material 22 is between each of the terminal's conductive material 14. More particularly, the crimp opening 42 has serrations which assist in the securing of the terminals 26 to the cord 66.

The above steps are then repeated until a plurality of spaced apart insulated contact terminals 26 is provided in a continuous, uninterrupted strip. This strip forms the connector 10.

The above described process of repeatedly stamping and crimping to form a continuous strip of adjacent, spaced apart contact terminals 26, utilizes a zipper chain machine, like the one described above. As a result, an electrical connector is formed, which is less expensive to manufacture than the aforementioned electrical connectors.

After the terminal strips 18 are formed, the continuous strip can be cut to accommodate any size of connector 10 required. For example, if only two terminals 26 are required, two terminals will be severed from the strip. In the alternative, the continuous plurality of terminals 26 can be stored in some fashion until needed If storage is to occur, it is critical that the insulation material accurately maintain the positioning of the terminals over time. For storage reasons, it is important that the insulation material have some flexibility, to facilitate wrapping the strip 68 around a reel or the like.

Figure 7:
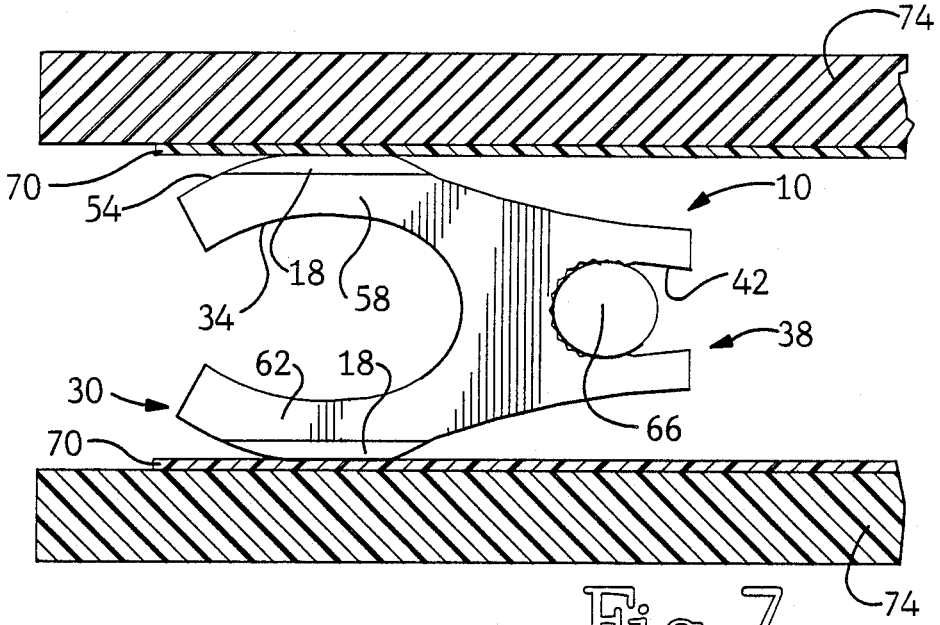
FIG. 7 is a view of the connector similar to FIG. 4, only with the connector positioned between circuit pads on generally parallel printed circuit boards.
Figure 8:
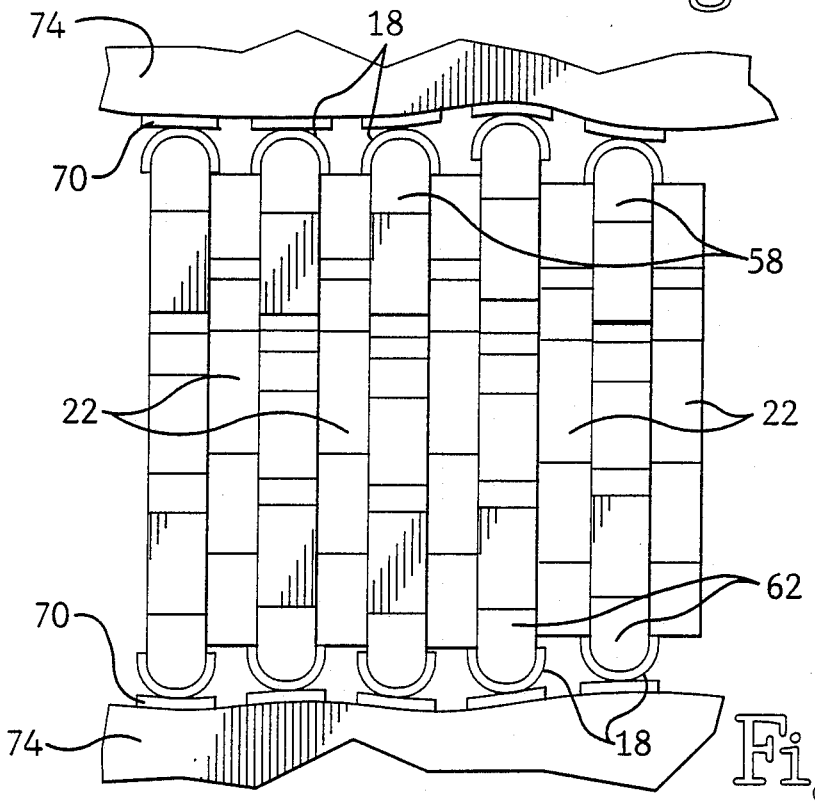
FIG. 8 is a side view of the connector between circuit boards, as shown in FIG. 7, showing the spring end of the terminals compensating for warpage in the printed circuit boards.

The plurality of contact terminals 26 can be used anywhere where connection between circuit pads 70 on two parallel planes is desired. More particularly, as illustrated in FIGS. 7 and 8, the connector 10 is shown located between the circuit pads 70 of two circuit boards 74 The connector 10 is held in place by a suitable housing (not shown), similar to the way in which the contact modules are positioned between the circuit boards in U.S. Pat. No. 4,699,593, which is incorporated herein by reference.

As is shown in FIG. 8, the flexibility of the strip of terminals 26 provides the means to allow the connector to adequately accommodate irregular and warped board surfaces. This flexibility insures that the terminals 26 of the connector will provide a positive electrical connection with the circuit pads 70 of the boards.

The flexibility provided in the strip is provided by the flexibility of the contact terminal spring ends 30 and the flexible insulating cord 66. The spring ends 30 are configured to allow the ends to be stressed toward each other, without the ends taking a permanent set. The resiliency of the material used to manufacture the terminal enhances these resilient characteristics. Consequently, when the terminals are positioned between circuit boards 74, the spring ends 30 of the terminal can resiliently deform to accommodate for any warpage of the boards. This resilient deformation of the terminals insures that each terminal will exert a sufficient force on the respective circuit pads 70 to maintain a positive electrical connection therebetween.

Flexible insulating cord 66 also allows the terminals to effect a positive electrical connection when the boards are irregularly shaped or warped. As was previously described, terminals 26 are crimped onto insulating cord 66. The insulating cord 66 is therefore the means which maintains the terminals in place relative to each other. Consequently, as cord 66 is flexible, terminals 26 are able to move relative to each other in a direction which is essentially perpendicular to the axis of the cord 66. This movement of the terminals allows the terminals to "float" in order to compensate for board warpage and irregular shape.

The flexibility of the connector is important to provide a positive electrical connection. In particular, the configuration of the connector allows the terminals 26 and cord 66 to adequately compensate for varied spacing between boards 74, without causing either the terminals 26 or the cord 66 to take a permanent set. Consequently, the connector described herein can be used over many cycles.

Various other features of the invention are set forth in the following claims.

I claim:

1. An electrical connector comprising an electrically insulating, flexible carrier strip, a plurality of adjacent contact terminals, each of said contact terminals being crimped on said carrier in a spaced apart fashion to form a continuous, uninterrupted contact strip, the contact terminals having electrically insulating material provided on side surfaces thereof, the electrically insulating material providing the spacing between the respective contact terminals. whereby the contact terminals may be bent as required.

2. An electrical connector as recited in claim 1 wherein said the insulating carrier strip is a cord of flexible material.

3. An electrical connector as recited in claim 1 for use in interconnecting a pair of circuit boards, wherein the contact terminals have a spring end which has resilient contact arms, the resilient contact arms cooperate with contact surfaces provided on the respective printed circuit boards, such that as the electrical connector is placed between the two circuit boards, the resilient contact arms are moved to a stressed position, in order to compensate for the warpage associated with the respective printed circuit boards.

4. An electrical connector as recited in claim 1 wherein the insulating material is sprayed onto the contact terminals.

5. An electrical connector as recited in claim 4 wherein the insulating material is applied to one side of each respective contact terminal.

6. An electrical connector as recited in claim 4 wherein the free edges of the contact arms are free of insulating material.

7. An electrical connector for use in interconnecting a pair of circuit boards, the connector comprising an electrically insulating, flexible carrier strip, a plurality of adjacent contact terminals, each of said contact terminals being crimped on said carrier in a spaced apart fashion to form a continuous, uninterrupted contact strip, the contact terminals have spring ends which have resilient contact arms, the resilient contact arms cooperate with contact surfaces provided on the respective printed circuit boards, such that as the electrical connector is placed between the two circuit boards, the resilient contact arms are moved to a stressed position, in order to compensate for the warpage associated with the respective printed circuit boards.

8. An electrical connector as recited in claim 7 wherein the contact terminals have electrically insulating material provide on side surfaces thereof, the electrically insulating material providing the spacing between the respective contact terminals.

9. An electrical connector as recited in claim 8 wherein the insulating material is sprayed onto the contact terminals.

10. An electrical connector as recited in claim 9 wherein the insulating material is applied to one side of each respective contact terminal.

11. An electrical connector as recited in claim 9 wherein the free edges of the contact arms are free of insulating material.

12. An electrical connector as recited in claim 7 wherein the insulating carrier strip is a cord of flexible materials, such that the continuous, uninterrupted contact strip may be bent as required.

* * * * *